US005790011A

United States Patent [19]

Hirano et al.

[11] Patent Number: 5,790,011

[45] Date of Patent: Aug. 4, 1998

[54] POSITIVE CHARACTERISTICS THERMISTOR DEVICE WITH A POROSITY OCCUPYING RATE IN AN OUTER REGION HIGHER THAN THAT OF AN INNER REGION

[75] Inventors: Atsushi Hirano, Ohmihachiman; Shigeyuki Kuroda; Kenji Tanaka, both of Shiga-ken, all of Japan

[73] Assignee: Murata Manufacturing Co., Ltd., Nagaokakyo, Japan

[21] Appl. No.: 671,736

[22] Filed: Jun. 28, 1996

[30] Foreign Application Priority Data

Jun. 29, 1995 [JP] Japan ..... 7-163615

[51] Int. Cl.[6] ..... H01C 7/10; H01C 7/13

[52] U.S. Cl. ..... 338/22 R

[58] Field of Search ..... 338/22 R, 25, 338/314, 23, 24

[56] References Cited

U.S. PATENT DOCUMENTS

| | | | |
|---|---|---|---|
| 3,644,864 | 2/1972 | Hirsbrunner et al. | 338/2 J |
| 3,958,208 | 5/1976 | Blaha | 338/22 R |
| 4,259,657 | 3/1981 | Ishikawa et al. | 338/22 R |
| 5,214,738 | 5/1993 | Nakajima et al. | 338/22 R |
| 5,245,309 | 9/1993 | Kawase et al. | 338/22 R |
| 5,380,989 | 1/1995 | Ohkubo | 219/667 |

OTHER PUBLICATIONS

Patent Abstracts of Japan, vol. 014, No. 082 (E–0889), 15 Feb. 1990, & JP 01 293502 A (Murata MFG Co Ltd), 27 Nov. 1989, (English Abstract).

Patent Abstracts of Japan, vol. 017, No. 310 (E–1380), 14 Jun. 1993 & JP 05 029104 A (Murata MFG Co Ltd), 5 Feb. 1993, (English Abstract).

Patent Abstracts of Japan, vol. 008, No. 242 (P–311), 7 Nov. 1984 & JP 59 116536 A (Matsushita Denki Sangyo KK), 5 Jul. 1984, (English Abstract).

Patent Abstracts of Japan, vol. 013, No. 431 (C–640), 26 Sep. 1989 & JP 01 167283 A (Honda Motor Co Ltd), 30 Jun. 1989, (English Abstract).

Patent Abstracts of Japan, vol. 015, No. 484 (C–0892), 9 Dec. 1991 & JP 03 208870 A (Oriental Sangyo KK), 12 Sep. 1991, (English Abstract).

H.T. Sun et al., "Porosification Effect on Electroceramic Properties," *Key Engineering Materials*, 1996, Trans Tech Publications, Switzerland, vol. 115, ISSN 1013–9826, pp. 167–180, XP000646633.

Shi-Mei Su et al., "Preparation of Porous $BaTiO_3$ PTC Thermistors by Adding Graphite Porosifiers," *Journal of The American Ceramic Society*, Aug. 1994, USA, vol. 77, No. ISSN 0002–7820, pp. 2154–2156, XP000647760.

*Primary Examiner*—Edward Tso

*Attorney, Agent, or Firm*—Burns, Doane, Swecker & Mathis, LLP

[57] ABSTRACT

There is provided a positive characteristics thermistor device having excellent thermal breakdown characteristics. According to the present invention, a positive characteristics thermistor device has a positive characteristics thermistor element 1 and electrodes 2 and 3 formed on principal surfaces of the positive characteristics thermistor element 1. The positive characteristics thermistor element 1 includes an inner region 4 and outer regions 5 and 6 and a porosity occupying rate of the outer regions 5 and 6 is set higher than that of the inner region 4.

20 Claims, 1 Drawing Sheet

POSITIVE CHARACTERISTICS THERMISTOR DEVICE WITH A POROSITY OCCUPYING RATE IN AN OUTER REGION HIGHER THAN THAT OF AN INNER REGION

BACKGROUND OF THE INVENTION

1. Field of the Invention

The present invention relates to positive characteristics thermistor devices and, more particularly, to a technique for improving thermal breakdown characteristics against a surge current.

2. Description of the Related Art

A semiconductor ceramic having positive temperature characteristics of resistance, i.e., temperature characteristics of resistance such that resistance abruptly increases at a temperature equal to or higher than the Curie point, can be obtained by adding a small amount of impurities and additives to barium titanate. Such a semiconductor ceramic is used to provide positive characteristics thermistor devices used in applications such as automatic degaussing, the activation of a motor, protection against overcurrent, and heaters.

As shown in FIG. 4, a specific positive characteristics thermistor device of this type generally has a positive characteristics thermistor element 11 in the form of a disc or the like made of a semiconductor ceramic having positive temperature characteristics of resistance and electrodes 12 and 13 formed on both principal surfaces thereof. Lead wires (not shown) are connected to each of the electrodes 12 and 13 by means of soldering or the like.

In the positive characteristics thermistor device, heat is generated in the positive characteristics thermistor element 11 when a voltage is applied thereto through the electrodes 12 and 13. Measurement of such generation of heat in the positive characteristics thermistor element 11 using an infrared temperature analyzer indicates that there is a temperature difference between a central portion, i.e., an inner region, of the positive characteristics thermistor element 11 and portions closer to both the principal surfaces and circumferential surfaces, i.e., outer regions thereof, as apparent from the isothermal lines T represented by imaginary lines. Such a temperature difference is considered attributable to the following. The principal surfaces and the circumferential surfaces of the positive characteristics thermistor element 11 are in contact with the atmosphere. While a greater amount of heat dissipation at the portions closer to both the principal surfaces and the circumferential surfaces tends to result in a lower temperature in those portions, the central portion tends to have a higher temperature because of a less amount of heat dissipation.

Such a temperature difference results in a higher resistance at the central portion of the positive characteristics thermistor element 11 than the portions closer to both the principal surfaces and circumferential surfaces. Further, thermal stress develops earlier in the central portion than in the portions closer to both the principal surfaces and circumferential surfaces. This increases the difference in the states of thermal equilibrium at those portions, thereby increasing the possibility of a breakdown of the positive characteristics thermistor element 11. Especially, this has resulted in the problem of abrupt breakdown of the positive characteristics thermistor element 11 in applications such as automatic degaussing, motor activation, and protection against overcurrent wherein a relatively high surge current is applied.

The present invention has been conceived taking the above-described problem into consideration, and it is an object of the invention to provide a positive characteristics thermistor device having excellent thermal breakdown characteristics.

SUMMARY OF THE INVENTION

According to the present invention, there is provided a positive characteristics thermistor device having a positive characteristics thermistor element and electrodes formed on principal surfaces of the positive characteristics thermistor element, characterized in that the above-described object is achieved by providing the positive characteristics thermistor element with an inner region and an outer region and by setting the porosity occupying rate of the outer region higher than that of the inner region.

According to the above-described arrangement wherein the outer region of the positive characteristics thermistor element has porosity occupying rate higher than that of the inner region thereof, portions closer to both of the principal surfaces and the circumferential surfaces which are outer regions have a higher temperature than that of a central portion, i.e., an inner region, because those portions have less thermal conduction paths and therefore a higher specific resistance compared to the central portion. This reduces the temperature difference between the central portion of the positive characteristics thermistor element and the portions closer to both the principal surfaces and the circumferential surfaces, thereby reducing the difference in the states of thermal equilibrium thereof. Further, in this case, the pores dispersed throughout the positive characteristics thermistor element absorb or relax thermal stress generated therein, which reduces the possibility of the thermal breakdown of the positive characteristics thermistor element.

DETAILED DESCRIPTION OF THE PREFERRED EMBODIMENT

The preferred embodiments of the present invention will now be described with reference to the drawings.

Figure 1:
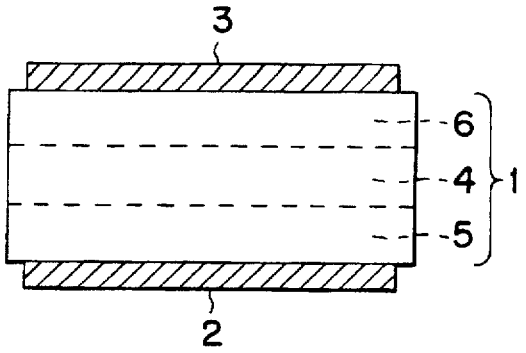
FIG. 1 is a side sectional view showing the structure of a positive characteristics thermistor device according to a first embodiment of the present invention.

FIG. 1 is a side sectional view showing the structure of a positive characteristics thermistor device according to a first embodiment of the present invention. This positive characteristics thermistor device includes a positive characteristics thermistor element 1 made of a semiconductor ceramic having positive temperature characteristics of resistance in the form of a plate, e.g. in the form of a disc whose outer surface is constituted by both principal surfaces and circumferential surfaces and includes electrodes 2 and 3 formed on the respective principal surfaces. Lead wires (not shown) are connected to each of the electrodes 2 and 3 by means of soldering or the like.

The positive characteristics thermistor element 1 has a flat or planar inner region 4, i.e., the central portion thereof, and flat or planar outer regions 5 and 6, i.e., portions closer to both the principal surfaces thereof, which are divided in the direction of the thickness thereof. The porosity occupying rate of the outer regions 5 and 6 is set higher than that of the inner region 4. More specifically, the positive characteristics thermistor element 1 includes an inner region 4 having a predetermined porosity occupying rate, e.g., 11–13%, for example, and outer regions 5 and 6 having a higher porosity occupying rate of about 14–15%, for example, which are provided between the electrodes 2 and 3 and the inner region 4.

The outer regions 5 and 6 are exposed on both principal surfaces of this positive characteristics thermistor element 1, and the boundaries between the inner region 4 and the outer regions 5 and 6 are exposed on the circumferential surfaces thereof in this embodiment. The porosity occupying rate of the inner region 4 and outer regions 5 and 6 is not limited to the above-mentioned values and, for example, the porosity occupying rate of the outer regions 5 and 6 may be about 19%. Briefly, the size and number of the pores in the positive characteristics thermistor element 1 may be arbitrarily set provided that the porosity occupying rate of the outer regions 5 and 6 is higher than the porosity occupying rate of the inner region 4.

A description will now be made on steps for producing the positive characteristics thermistor element 1 having the above-described configuration. The first step is to prepare a first thermistor material X, e.g., $(Ba.Sr.Pb.Ca.Y.Mn)TiO_3+SiO_2$, and a second thermistor material Y which is obtained by adding about 2% by weight of spherical resin beads having a diameter of about 10–30 μm mainly composed of PMMA (polymethylmethacrylate) to the first thermistor material X. It is not essential that the resin beads satisfy the above-described conditions, and they are only to satisfy requirements that their main component disappears as a result of burning and that the shape and diameter thereof allow the formation of pores larger than the pores which are originally included in the semiconductor ceramic. Further, the amount of the resin beads added may be appropriately set in accordance with the desired characteristics. For example, about 1% by weight of resin beads may be added to the first thermistor material X while about 2% by weight of resin beads may be added to the second thermistor material Y.

Next, the first and second thermistor materials X and Y were molded using a dry pressing machine. Specifically, a molded element was obtained as follows.

(1) First, a predetermined amount, i.e., about 0.62 g, of the second thermistor material Y was filled in a metal mold forming a part of the dry press machine and was then pressurized at a pressure as low as about 40 MPa to form a part corresponding to the outer region 5 of the positive characteristics thermistor element 1.

(2) Then, a predetermined amount, i.e., about 0.62 g, of the first thermistor material X was filled on the part corresponding to the outer region 5 in the metal mold and was then pressurized at a pressure as low as about 40 MPa to form a part corresponding to the inner region 4 of the positive characteristics thermistor element 1.

(3) Further, a predetermined amount, i.e., about 0.62 g, of the second thermistor material Y was filled on the part corresponding to the inner region 4 in the metal mold and was then pressurized at a pressure as high as about 120 MPa to form a part corresponding to the outer region 6 of the positive characteristics thermistor element 1. At the same time, compression was performed on those parts as a whole to obtain a molded element.

Thereafter, the resultant molded element was burned at a temperature of about 1340° C. to obtain the positive characteristics thermistor element 1. During the burning, the resin beads added to the second thermistor material Y disappear leaving pores at the places they have occupied. Thus, the porosity occupying rate of the outer regions 5 and 6 of the positive characteristics thermistor element 1 is set higher than that of the inner region 4. Specifically, if the second thermistor material Y is added with 2% by weight of resin beads having a diameter of 20 μm, the porosity occupying rate of the outer regions 5 and 6 made of the second thermistor material Y is 14–15%. On the other hand, porosity occupying rate is 11–13% for the inner region 4 made of the first thermistor material X which is not added with the resin beads. It goes without saying that the porosity can be increased by increasing the amount of the resin beads added and can be decreased by decreasing the amount of the resin beads added.

Further, if the burning is performed after applying conductive paste on both principal surfaces of the positive characteristics thermistor element 1, a positive characteristics thermistor device is obtained with electrodes 2 and 3 made of Ni—Ag or the like formed thereon. A positive characteristics thermistor device produced through such steps has a diameter of about 14 mm and a thickness of about 2 mm.

The inventors then measured the flash withstand voltage (V), i.e., the withstand voltage against a surge current, of a positive characteristics thermistor device having the structure shown in FIG. 1 produced through the steps according to the present embodiment representing the resistance (Ω) and thermal breakdown characteristics thereof. Table 1 shows the result of this measurement. Table 1 also shows the resistance (Ω) and flash withstand voltage (V) of a positive characteristics thermistor device including a positive thermistor element made of only the thermistor material X as an example for comparison. The flash withstand voltages shown were obtained as follows. A voltage of 100 V was applied for 5 seconds and, thereafter, the resistance of the positive characteristics thermistor element 1 was measured after decreasing the temperature of the same to a normal temperature. If the measured resistance was the same as the initial resistance, the same measurement was repeated at increased voltages to find a voltage at which a change occurred in the measured resistance.

TABLE 1

| | Embodiment of Invention | Example for Comparison |
|---|---|---|
| Resistance (Ω) | 6 | 6 |
| Flash Withstand Voltage (V) | 500 | 280 |

It is apparent from Table 1 that the positive characteristics thermistor device of the present embodiment has been improved to have a flash withstand voltage of 500 V which is 1.8 times the flash withstand voltage 280 V of the positive characteristics thermistor element as an example for comparison. Specifically, the positive characteristics thermistor element 1 constituting the positive characteristics thermistor device of the embodiment has an inner region 4, i.e., the central portion thereof, and outer regions 5 and 6, i.e., the portions closer to both the principal surfaces thereof, which are divided in the direction of the thickness thereof, and the porosity occupying rate of the outer regions 5 and 6 is set higher than that of the inner region 4. As a result, the portions closer to principle surfaces of the positive characteristics thermistor element 1 have less thermal conduction paths and therefore a higher specific resistance compared to the central portion. This results in an increase in the temperature of those portions and a corresponding decrease in the temperature difference between the central portion and the portions closer to both principal surfaces, thereby reducing the difference in the states of thermal equilibrium thereof. At the same time, the pores dispersed throughout the positive characteristics thermistor element 1 absorb or relax thermal stress generated therein. The improvement of flash withstand voltage is considered attributable to the above-described arrangement.

In the above-described steps for producing a positive characteristics thermistor element according to the embodiment, a molded element as the positive characteristics thermistor element 1 is made using a dry pressing machine. Alternatively, the molded element may be made by forming a multiplicity of ceramic green sheets to which are added different amounts of resin beads using a known extrusion molding process, scalpel blade process, or the like and then laminating and contact-bonding those ceramic green sheets. Although not shown, the fabrication of the molded element through such steps provides an advantage in that a positive characteristics thermistor element consisting of a multiplicity of layers divided in the direction of the thickness thereof can be formed, and the porosity occupying rate can be set to continuously increase so that a layer has porosity occupying rate higher than that an inward layer.

Figure 2:
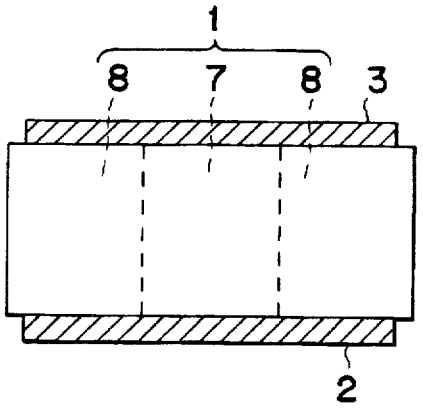
FIG. 2 is a side sectional view showing the structure of a positive characteristics thermistor device according to a second embodiment of the present invention.

FIG. 2 is a side sectional view showing the structure of a positive characteristics thermistor device according to a second embodiment of the present invention. Like the first embodiment, the positive characteristics thermistor device of this embodiment includes a positive characteristics thermistor element 1 in the form of a disc or the like made of a semiconductor ceramic having positive temperature characteristics of resistance and includes electrodes 2 and 3 formed on both principal surfaces to which lead wires (not shown) are to be connected. The parts in FIG. 2 identical or corresponding to those in FIG. 1 are designated by the same reference numbers and are not described in detail here.

The positive characteristics thermistor element 1 that constitutes the positive characteristics thermistor device of this embodiment includes an inner region 7 which is a cylindrical central portion provided in the center thereof in the direction of the expanse of both the principal surfaces and includes annular shaped outer regions 8 which are portions closer to the circumferential surfaces thereof provided to surround the sides of the inner region 7. The porosity occupying rate of the outer regions 8 is set higher than that of the inner region 7. The boundaries between the inner region 7 and outer regions 8 are exposed on both principal surfaces of this positive characteristics thermistor element 1, and the outer regions 8 are exposed on the circumferential surfaces thereof. The porosity occupying rate of the inner region 7 is about 11–13%, and the porosity occupying rate of the outer regions 8 is about 14–15%.

In this embodiment, the positive characteristics thermistor element 1 is formed by the inner region 7, i.e., the central portion thereof, and the outer regions 8, i.e., the portions closer to the circumferential surfaces thereof, and the porosity occupying rate of the outer regions 8 is set higher than that of the inner region 7. As a result, the portions closer to the circumferential surfaces of the positive characteristics thermistor element 1 have less thermal conduction paths and therefore a higher specific resistance compared to the central portion. This results in an increase in the temperature of those portions and a corresponding decrease in the temperature difference between the central portion and the portions closer to both principal surfaces, thereby reducing the difference in the states of thermal equilibrium thereof. In addition, the pores dispersed throughout the positive characteristics thermistor element 1 absorb or relax thermal stress generated therein. As a result, the thermal breakdown characteristics are improved.

Figure 3:
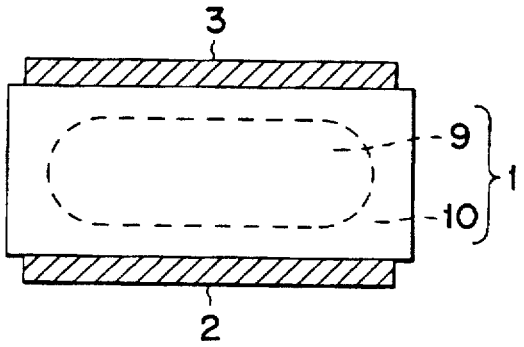
FIG. 3 is a side sectional view showing the structure of a positive characteristics thermistor device according to a third embodiment of the present invention.
Figure 4:
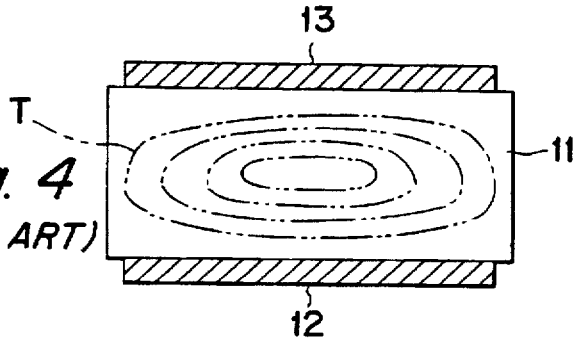
Fig. 4 (PRIOR ART)
FIG. 4 is a side sectional view showing the structure of a positive characteristics thermistor device according to the prior art.

FIG. 3 is a side sectional view showing the structure of a positive characteristics thermistor device according to a third embodiment of the present invention. Like the first and second embodiments, the positive characteristics thermistor device of this embodiment includes a positive characteristics thermistor element 1 in the form of a plate, e.g., a disc whose outer surface is constituted by both principle surfaces and circumferential surfaces thereof, made of a semiconductor ceramic having positive temperature characteristics of resistance and includes electrodes 2 and 3 formed on both principal surfaces to which lead wires (not shown) are to be connected. The parts in FIG. 3 identical or corresponding to those in FIG. 1 and FIG. 2 are designated by the same reference numbers and are not described in detail here.

The positive characteristics thermistor element 1 includes an inner region 9 which is a central portion provided in the center thereof in the direction of the thickness and in the direction of the expanse of both the principal surfaces and includes an outer region 10 which is a portion encasing the inner region 9, i.e., formed on both of the principal surfaces and the circumferential surfaces provided to surround the inner region 9. The porosity occupying rate of the outer region 10 is set higher than that of the inner region 9. Specifically, the positive characteristics thermistor element 1 of the present embodiment is constituted by an inner region 9 having porosity occupying rate of about 11–13% and an outer region 10 having porosity occupying rate of about 14–15% provided to surround the entire periphery of the inner region 10. Only the outer region 10 is exposed on both principal surfaces and the circumferential surfaces of this positive characteristics thermistor element 1.

Since the positive characteristics thermistor element 1 of this embodiment includes the outer region 10 having porosity occupying rate set higher than that of the inner region 9, the portions closer to both principal surfaces and the circumferential surfaces which are the outer region 10 have less thermal conduction paths and therefore a higher specific resistance compared to the central portion which is the inner region 9. This results in an increase in the temperature of those portions and a corresponding decrease in the temperature difference between those regions and the central portion, thereby reducing the difference in the states of thermal equilibrium thereof. In addition, thermal stress generated is absorbed or relaxed by the pores. As a result, the thermal breakdown characteristics are improved as in the first and second embodiments.

The present invention is not limited to the embodiment specifically described above, and it is needless to say that various applications and modifications are possible within the scope of the principle of his invention. For example, two or more outer regions may be provided outside an inner region forming a positive characteristics thermistor element. This arrangement may be applied to the first embodiment to provide a configuration wherein each of the outer regions 5 and 6 respectively provided between the electrodes and the inner region 4 is constituted by two or more outer regions having different porosity occupying rate. When such a configuration is employed, it is preferred that the porosity occupying rate increases as the distance from the inner region 4 increases. Furthermore, although both of the inner and outer regions are made of thermistor materials having basically the same composition in the above embodiments, it goes without saying that they may be made of thermistor materials having different compositions and by different processes.

As described above, in a positive characteristics thermistor device according to the present invention, an outer region forming a part thereof has porosity occupying rate higher than that of an inner region. As a result, portions closer to the both principal surfaces and the circumferential surfaces thereof which are the outer region have less thermal conduction paths and therefore a higher specific resistance compared to the central portion thereof which is the inner region. This results in a greater increase in the temperature of the portions closer to both principal surfaces and the circumferential surfaces than that in the central portion. This reduces the temperature difference between the central portion and the portions closer to the both principal surfaces and the circumferential surfaces and therefore the difference in the states of thermal equilibrium thereof. Thus, there is provided an advantage in that the thermal breakdown characteristics against a surge current is improved.

In addition, the present invention allows thermal stress generated in a positive characteristics thermistor element to be absorbed or relaxed by pores, reducing the possibility of the breakdown of the same. This makes it possible to provide a positive characteristics thermistor device having improved thermal breakdown characteristics.

While particular embodiments of the present invention have been shown and described, it will be obvious to those skilled in the art that changes and modifications may be made without departing from this invention in its broader aspects and, therefore, the appended claims are to encompass within their scope all such changes and modifications as a whole within the true spirit and scope of this invention.

What is claimed is:

1. A positive characteristics thermistor device comprising:

a positive characteristics thermistor element; and electrodes formed on principal surfaces of said positive characteristics thermistor element, wherein said positive characteristics thermistor element comprises an inner region and an outer region, and a porosity occupying rate of said outer region is set higher than that of said inner region.

2. The device according to claim 1, wherein said outer region includes a portion of said positive characteristics thermistor element between said inner region and one of said electrodes and another portion of said positive characteristics thermistor element between said inner region and the other of said electrodes.

3. The device according to claim 2, wherein said portions of said positive characteristics thermistor element are in the form of planar layers.

4. The device according to claim 1, wherein said positive characteristics thermistor element is divided in the direction of its thickness into portions comprising said outer region and a portion comprising said inner region.

5. The device according to claim 1, wherein said outer region includes a circumferential portion of said positive characteristics thermistor element and said inner region includes a central portion of said positive characteristics thermistor element.

6. The device according to claim 4, wherein said inner portion has a cylinder shape and said outer portion has an annular shape.

7. The device according to claim 1, wherein said outer region completely encases said inner region.

8. A positive characteristics thermistor device comprising:

a positive characteristics thermistor element; and electrodes formed on principal surfaces of said positive characteristics thermistor element, wherein a porosity occupying rate is set to continuously increase so that an outer layer has a higher porosity occupying rate relative to that of an inner layer.

9. The device according to claim 8, wherein said layers are flat.

10. The device according to claim 8, wherein said layers include cylindrical ring-shaped layers.

11. The device according to claim 8, wherein said outer layers encase inner layers.

12. A thermistor device comprising:

a thermistor element; and electrodes formed on surfaces of said thermistor element, wherein said thermistor element comprises an inner region and an outer region, and a porosity occupying rate of said outer region is set higher than that of said inner region.

13. A method of making a positive characteristics thermistor element comprising the steps of:

preparing a first thermistor material;

preparing a second thermistor material, wherein said step of preparing said second thermistor material includes forming pores in said second thermistor material which are larger than pores in said first thermistor material;

molding said first and second thermistor materials; and burning the resultant molded element to obtain the positive characteristics thermistor element.

14. The method according to claim 13, wherein said step of preparing a second thermistor material includes adding resin beads to the first thermistor material.

15. The method according to claim 13, wherein said step of preparing a second thermistor material includes adding about 2% by weight of spherical resin beads having a diameter of about 10–30 μm and including polymethylmethacrylate to the first thermistor material.

16. The method according to claim 13, wherein said step of preparing a second thermistor material includes adding to the first thermistor material a substance having a main component which disappears as a result of said burning step.

17. The method according to claim 13, wherein said step of preparing a second thermistor material includes adding to the first thermistor material a substance having a main component which disappears as a result of said burning step and having a shape and diameter to allow for the formation of pores larger than the pores which are in said first thermistor material.

18. The method according to claim 13, wherein said step of molding includes the steps of:

placing a predetermined amount of said second thermistor material in a mold forming a part of a dry press machine;

pressurizing said second thermistor material in said mold to form a first part;

placing a predetermined amount of the first thermistor material on the pressurized first part;

pressurizing said first and second thermistor material in said mold to form a combined first and second part;

placing a predetermined amount of said second thermistor material on said combined first and second part; and then pressurizing said first and second materials in said mold to form said positive characteristics thermistor element.

19. The method according to claim 18, wherein said step of pressurizing said first and second materials in said mold to form said positive characteristics thermistor element is performed at a pressure higher than the other pressurizing steps.

20. The method according to claim 13, wherein said step of preparing a second thermistor material includes adding to the first thermistor material a substance having a main component which disappears as a result of said burning step and having a shape and diameter to allow for the formation of pores the number of which is more than the number of pores which are in said first thermistor material.

* * * * *